US005145549A

United States Patent [19]

Mosburger

[11] Patent Number: 5,145,549

[45] Date of Patent: Sep. 8, 1992

[54] APPARATUS FOR PRODUCING ONE-SIDED CORRUGATED PAPERBOARD

[75] Inventor: Hans Mosburger, Weiherhammer, Fed. Rep. of Germany

[73] Assignee: BHS-Bayerische Berg-, Hutten-und Salzwerke AG, Fed. Rep. of Germany

[21] Appl. No.: 747,791

[22] Filed: Aug. 19, 1991

[51] Int. Cl.[5] ..... B31F 1/28

[52] U.S. Cl. ..... 156/382; 156/472; 156/473; 118/65

[58] Field of Search ..... 156/381, 382, 471, 472, 156/473; 118/249, 250, 64, 65; 425/336, 369; 264/286

[56] References Cited

U.S. PATENT DOCUMENTS 4,261,784 4/1981 Saito ..... 156/473 X

FOREIGN PATENT DOCUMENTS 2935677 10/1982 Fed. Rep. of Germany .
3437190 4/1986 Fed. Rep. of Germany .
3833345 8/1989 Fed. Rep. of Germany .
1467195 1/1967 France .

*Primary Examiner*—Michael W. Ball
*Assistant Examiner*—Michele K. Yoder
*Attorney, Agent, or Firm*—Silverman, Cass & Singer, Ltd.

[57] ABSTRACT

A device for the production of one-sided corrugated paperboard with two corrugated rollers which corrugate a paper sheet. A glue mechanism for applying glue onto the corrugated paper sheet has a glue applying roller cooperating with a corrugated roller, a glue dosing element and a glue container. A pressing roller presses a cover sheet against the coated, corrugated paper sheet. Chambers are constructed on both sides of the glue applying roller. The chambers are sealed off, with their first edges against the first corrugated roller or the pressing roller and, with their other edges, are sealed off against the glue mechanism. The chambers have connections for high pressure sources, in order to press, by means of high pressure the corrugated sheet against the corrugated roller. Both edges of the pressure chambers sealing off against the glue mechanism cooperate with surfaces of the glue mechanism which do not convey any glue to the corrugated roller.

9 Claims, 2 Drawing Sheets

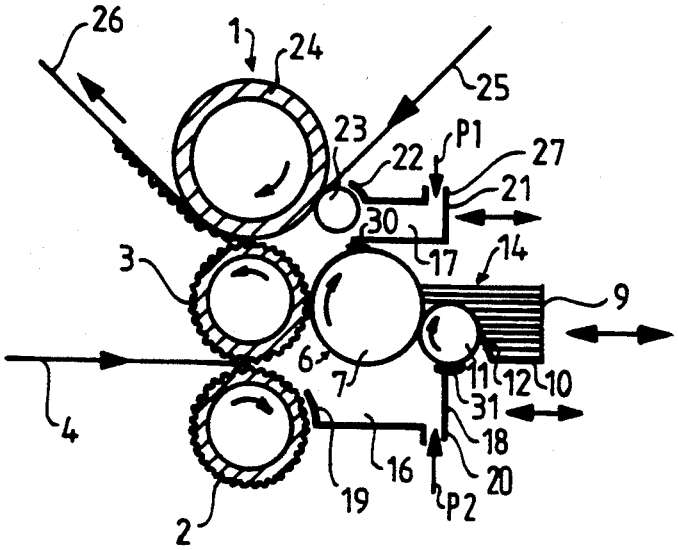
FIG. 3
FIG. 4
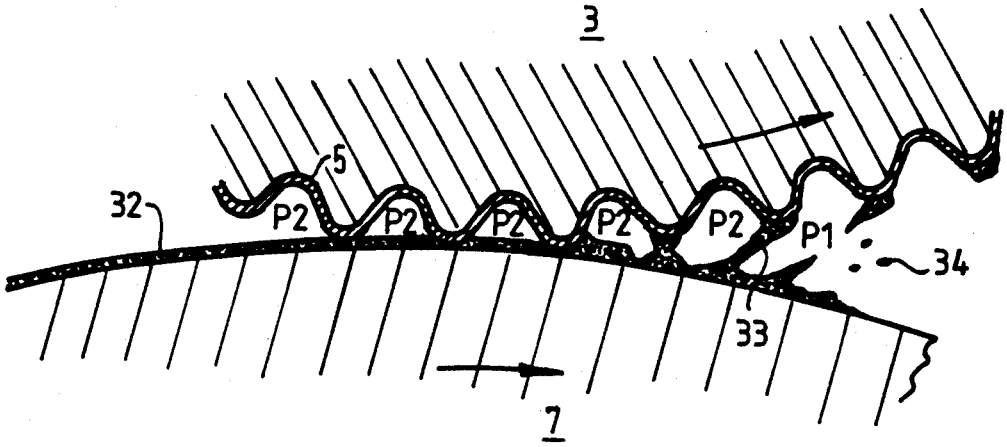

APPARATUS FOR PRODUCING ONE-SIDED CORRUGATED PAPERBOARD

BACKGROUND OF THE INVENTION

1. Field of the Invention

This invention relates to apparatus for producing one-sided corrugated paperboard using two corrugated rollers.

2. Description of the Prior Art

Prior Art French patent FR-PS 1 467 195 discloses high pressure chambers on both sides of a glue applying roller, by means of which a corrugated paper sheet is pressed, area by area, against a corresponding corrugated roller. The high pressure chambers are directly sealed off against the corresponding corrugated roller. As a result, the application of glue dispensed onto the paper sheet is impaired.

German patent DE-OS 34 37 190 discloses a device for sealing off the edges of pressure chambers formed on both sides of a glue applying roller against a corrugated roller or a pressing roller. The other edges of the pressure chambers are sealed off against the glue applying roller. The glue applying roller is provided with longitudinal grooves, the circumferential distribution of which corresponds to the distribution of teeth disposed on the corresponding corrugated roller. The glue to be applied is drawn from the troughs of the grooves on the glue applying roller. The sealing portions of the pressure chambers rub against the tops of the grooves and remove the glue therefrom. The excess glue which has been applied is not significantly diminished by the sealing portions of the pressure chambers, but the construction of the longitudinal grooves on the glue applying roller and the synchronous motion of the glue applying roller with its corresponding corrugated roller is expensive. In addition, at high operating speeds, glue particles are spun off during the transfer of the glue onto the corrugated roller. The application of the glue is thereby disrupted.

German patent 29 35 677 discloses apparatus to enclose the glue mechanism with a single pressure chamber which is connected to a pressure source. The edges of the pressure chamber are sealed off by sealing elements engaged against a pressing roller or the paper sheet with its associated corrugated roller. The corrugated roller entraining the corrugated sheet is provided with several annular grooves positioned at a distance from each other. By means of the annular grooves, the internal side of the corrugated sheet is brought into contact with the pressure source. The areas of the corrugated sheet between the glue applying roller and the corrugated roller or pressing roller are stressed with uniform pressure. This is disadvantageous for the application of glue. The danger is present, during transfer of the glue at high operating speeds, that a larger number of drops of glue will be spun off. In addition, the glue mechanism can only be maintained, during the use of a single pressure chamber, through access apertures within the chamber. Maintenance of such structure is complicated.

SUMMARY OF THE INVENTION

The invention is characterized by a device constructed in accordance with that of German patent DE-OS 34 37 190, but in such a manner that contamination by excess glue is reduced and access to the glue application mechanism is made possible. Because the pressure chambers only are sealed off, with their edges abutting surfaces which transfer no glue onto the corrugated roller, or do not carry glue from the dosing roller to the corrugated roller, the application of glue from the glue applying roller the corresponding corrugated roller is achieved in a less complex manner. Different pressures are obtained in both pressure chambers, whereby the greater pressure prevails in the pressure chamber connected to the pressing roller. Also, application of glue is improved, and contamination of the glue particles is prevented.

BRIEF DESCRIPTION OF THE DRAWINGS

FIG. 3 is a similar view showing a further embodiment of the invention; and

FIG. 4 is an enlarged partial sectional view illustrating the transfer of glue onto a corrugated sheet.

DESCRIPTION OF THE PREFERRED EMBODIMENTS

Figure 1:
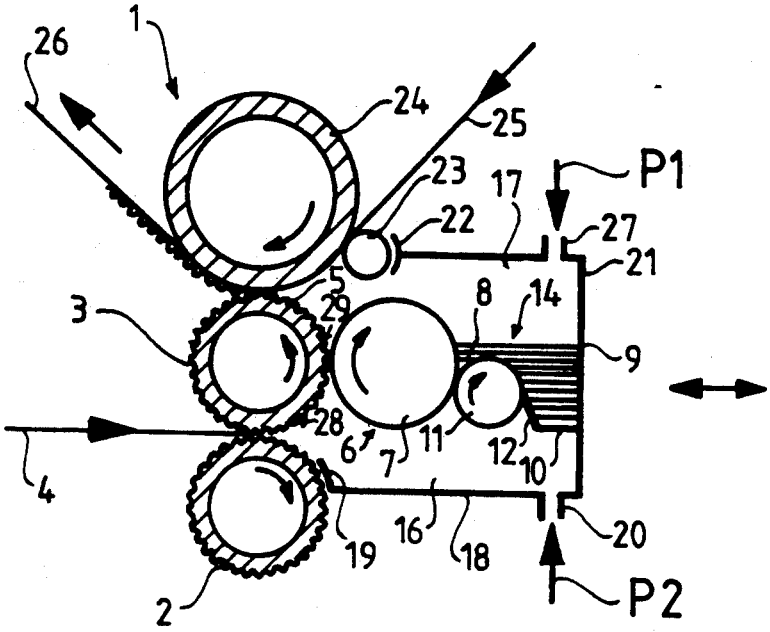
FIG. 1 is a schematic lateral view of a one-sided corrugated paperboard machine showing one embodiment of the invention.

A one-sided corrugated paperboard apparatus 1 schematically illustrated in FIG. 1 includes a first corrugated roller 2 and a second corrugated roller 3 which intermeshes with roller 1. The corrugated rollers 2, 3 are driven in the direction of the arrows shown thereon. The rollers 2, 3 are of generally hollow construction in order, for example, to permit the same to be heated with steam.

A paper sheet 4 is fed in the direction of the arrow applied thereto and is corrugated between the corrugated rollers 2, 3. The corrugated sheet 5 passes around approximately one-half of the circumferential area of the corrugated roller 3.

A glue mechanism 6 includes a glue applying roller 7 which is rotated in the direction of the arrow indicated. Roller 7 is pressed against the corrugated sheet 5 on the corrugated roller 3 and transfers glue 8 onto the top of the corrugated sheet 5.

The glue applying roller may, for example, draw glue 8 out of a glue container 9. The base 10 of the glue container 9 includes a glue dosing roller 11 which is rotated in the direction of the arrow indicated. The thickness of the application of glue is determined by the aperture between the glue applying roller 7 and the glue dosing roller 11. A stripping device 12 seals off the glue dosing roller 11 against the base 10 of the glue container 9. At the same time, glue 8 is stripped off of the glue dosing roller 11. The level of the glue 8 must at least rise above the glue dosing roller 11.

The glue mechanism 6—which consists of the glue applying roller 7, the dosing roller 11 and the stripping device 12 with the base 10—forms, for the glue container 9, a separating wall 14 for two pressure chambers, namely, the lower pressure chamber 16 and the upper pressure chamber 17. The pressure chamber wall 18 of the pressure chamber 16 is connected to the rear side of the glue container 9. On the other side, the pressure chamber wall 18 is sealed off, by means of a sealing member 19, against the corrugated roller 2. The pressure chamber 16 is, by means of a connection 20, connected to a high pressure source (not shown) having a pressure of P2. An air pressure source preferably is used.

The pressure chamber wall 21 of the pressure chamber 17 likewise is rigidly connected with the rear wall of the glue container 9. On the other side, the pressure chamber wall 21 is sealed off, by means of a sealing member 22 and a sealing roller 23, against a pressing roller 24. Pressing roller 24 presses a paper sheet 25, moving in the direction of the arrow indicated, against the corrugated sheet 5 provided with glue. The one-sided corrugated paperboard sheet 26 which results proceeds, in the direction of the arrow indicated, out of the one-sided corrugated paperboard machine 1.

The pressure chamber wall 21 is likewise provided with a connection 27. A high pressure source (not shown) with the excess pressure of P1, is connected to connection 27. An air pressure source preferably is applied.

The pressure chambers 16, 17 exert pressures Pl or P2 on the pressing areas 28, 29 of the corrugated sheet 5. In this manner, the corrugated sheet 5 is, even at high operating speeds of the one-sided corrugated paperboard machine, securely pressed against the corrugated roller 3. Improved pressing of the corrugated sheet against the corrugated roller 3 is attained if the corrugated roller 3 is provided, at longitudinal intervals, with annular grooves. A low pressure casing or suction nozzles engaging in the annular grooves of the corrugated roller 3 on the side positioned opposite to the glue applying roller 7 can also be provided to cooperate with such annular grooves. In this manner, a low pressure and a suction is thereby exerted, through the annular grooves, against the lower side of the corrugated sheet 5.

The pressures P1 and P2 can be equal or different. The pressure P1 preferably is greater than the pressure P2 with the result that splashing of glue during transfer to the sheet is reduced, as discussed hereinafter.

Figure 2:
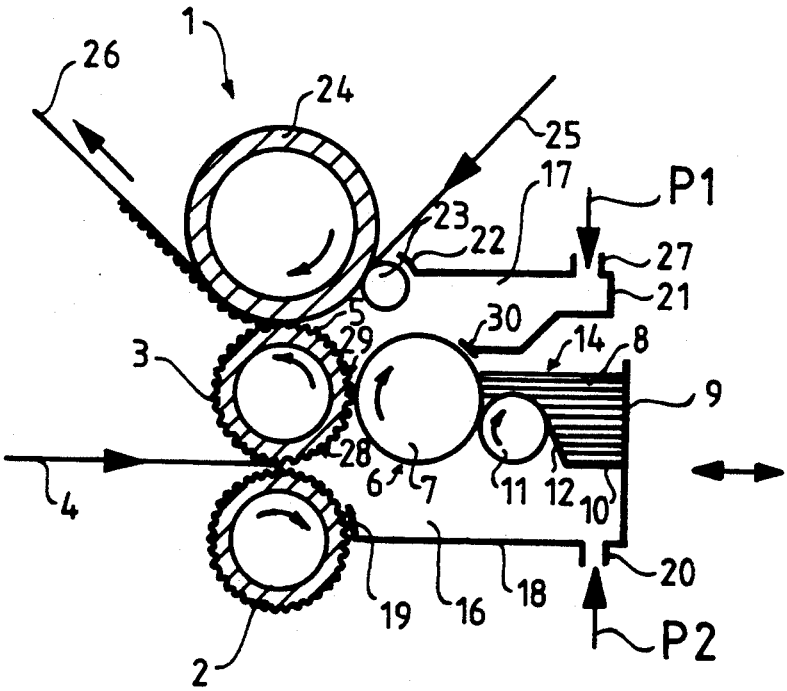
FIG. 2 is a view similar to that of FIG. 1 showing an alternate embodiment of the invention.

In the embodiment shown in FIG. 2, the only modification is that the pressure chamber wall 21 is not connected to the rear wall of the glue container 9, but rather, is sealed off by means of sealing member 30 against the glue applying roller 7. Sealing member 30 can serve as a groove for accommodation and removal of the glue stripped off of the glue applying roller 7.

In the embodiment shown in FIG. 3, the pressure chamber wall 18 or 21 is formed in a manner sealed off against the separating wall 14. The pressure chamber wall 18 preferably is sealed off by means of a sealing member 31 against the dosing roller 11. The sealing member 30, which preferably is constructed as a sealing aperture, and the sealing member 31, thereby are positioned in such a manner that they cooperate with the top of the glue applying roller 7 or of the glue dosing roller 11, in such a manner thai the glue mechanism 6 can be displaced, in the direction of the arrow indicated, separately from the pressure chambers 16 or 17. The pressure chambers 16, 17 likewise can be constructed so as to be displaceable in the directions of the arrows indicated. In the embodiments of FIGS. 1 and 2, the apparatus consisting of the glue mechanism 6 and the pressure chambers 16, 17 is displaceable only as a unit in the direction of the arrow indicated.

In the embodiment shown in FIG. 3, the glue mechanism 6, as well as the pressure chambers 16, 17, can be displaced independently of one another.

As seen in FIG. 4, the corrugated roller 3 is driven in the direction of the arrow indicated. The roller 3 is overlain with the corrugated papers sheet 5. The glue applying roller 7 pressed against the corrugated roller 3 is driven in the direction of the arrow indicated with slippage. The glue layer 32 carried along by the glue applying roller 7 is pressed through the first teeth of the corrugated roller 3 covered with the corrugated sheet 5 and, as a result of the slippage, is slid together. The teeth of the corrugated roller 3 thereby enclose, with the glue applying roller 7, longitudinal chambers with the excess pressure of P2. Within the outlet there are formed, between the teeth of the corrugated roller 3 and of the glue applying roller 7, arches of glue 33 which are eventually, under the influence of the higher pressure Pl, separated by the pressure P2. As a result of the stretching of the arches 33 which is caused by the differences in pressure, a reduced number of drops of spun-off glue 34 is created.

Various pressures P1, P2 in the chambers 16, 17 also can also be achieved by a pressure source connected, by an adjustable throttle valve, with the connections 20 or 27 of the chambers 16, 17.

I claim:

1. A device for the production of one-sided corrugated paperboard comprising, two corrugated rollers and a paper sheet passing therebetween to be corrugated, a glue mechanism for the application of glue onto the corrugated paper sheet, the glue mechanism including a glue applying roller cooperating with one corrugated roller, a glue dosing roller and a glue container, a pressing roller arranged to press a covering sheet against the glued corrugated paper sheet, two chambers disposed on different sides of the glue applying roller and sealed off, said chambers having first edges disposed respectively against one corrugated roller and said pressing roller, said chambers having second edges sealed off against the glue mechanism, connections in said chambers for pressure sources to press by means of pressure the corrugated sheet against the corrugated roller, said second edges of the chambers being in cooperative engagement with surfaces of the glue mechanism, but not in cooperative engagement with surfaces of the glue mechanism conveying glue from the dosing roller to the corrugated sheet against the corrugated roller.

2. A device as claimed in claim 1 in which the second edges of both chambers are tightly engaged with a rear wall of the glue container.

3. A device as claimed in claim 1 in which the second edge of one chamber is tightly engaged with a rear wall of the glue container, and a sealing member associated with the second edge of the other chamber is engaged against the glue applying roller at a location removed from the glue transferring point.

4. A device as claimed in claim 3 in which the sealing member is formed in a grooved configuration.

5. A device as claimed in claim 1 in which the second edge of one pressure chamber is sealed off against a low side of the dosing roller by a sealing member, the glue mechanism being positioned separately from the chambers to enable it to be moved with respect thereto.

6. A device as claimed in claim 1 in which the glue mechanism and the chambers are constructed as a unit and are movable together.

7. A device as claimed in claim 1 in which one chamber is associated with the pressing roller and has a higher pressure supplied thereto than the other chamber.

8. A device as claimed in claim 1 in whioh said one corrugated roller is formed with annular grooves positioned at intervals.

9. A device as claimed in claim 7 in which said one corrugated roller is formed with annular grooves positioned at intervals.

* * * * *